US007005806B2

(12) United States Patent
Shih

(10) Patent No.: US 7,005,806 B2
(45) Date of Patent: Feb. 28, 2006

(54) LIGHT DEVICE HAVING AUTOMATIC CONTROL DEVICE

(76) Inventor: Sen Tien Shih, No. 773, Jangtsao Road, Changhua (TW) 500

( * ) Notice: Subject to any disclaimer, the term of this patent is extended or adjusted under 35 U.S.C. 154(b) by 18 days.

(21) Appl. No.: 10/841,311

(22) Filed: May 7, 2004

(65) Prior Publication Data

US 2005/0248296 A1 Nov. 10, 2005

(51) Int. Cl.
*H05B 41/36* (2006.01)
*H05B 37/02* (2006.01)

(52) U.S. Cl. ..... 315/158; 315/291

(58) Field of Classification Search ..... 315/119, 315/129, 136, 149, 150, 158; 362/4, 5, 20, 362/555, 632, 642
See application file for complete search history.

(56) References Cited

U.S. PATENT DOCUMENTS 5,359,384 A * 10/1994 Ide ..... 396/51
5,930,060 A * 7/1999 Shih ..... 359/872
6,377,001 B1 * 4/2002 Levy ..... 315/312
6,402,338 B1 * 6/2002 Mitzel et al. ..... 362/154
6,791,284 B1 * 9/2004 Levy ..... 315/292
2005/0116171 A1 * 6/2005 Lee et al. ..... 250/342

* cited by examiner

*Primary Examiner*—Tuyet Vo
*Assistant Examiner*—Minh Dieu A
(74) *Attorney, Agent, or Firm*—Dellett & Walters

(57) ABSTRACT

A light device includes one or more light members disposed behind a hood, to generate lights. A remote detecting device may be used to detect whether one or more users go toward or go close to the light or not, and to actuate the light member to generate the lights when the users are detected to go toward the light. The light device may thus be actuated to generate light without being actuated or contacted by the users or without being operated or contacted by the users manually. A control device may be used to actuate the light member to generate the light. The remote detecting device includes a light emitting device to generate a light to detect whether the user goes toward the light or not.

1 Claim, 5 Drawing Sheets

LIGHT DEVICE HAVING AUTOMATIC CONTROL DEVICE

BACKGROUND OF THE INVENTION

1. Field of the Invention

The present invention relates to a light device, and more particularly to a light device having an automatic switch or control device to switch or to control light members to generate light automatically when users move toward the light device.

2. Description of the Prior Art

Typical light devices include one or more light members or elements provided for generating lights for lighting various objects or areas, such as for lighting dark environment, and include a switch to be actuated or operated by users, in order to control or actuate the light members or elements to generate the lights. However, the switches should be actuated by the hands of the users, but may not be actuated by the other portions of the users.

In order to solve the problem, the present applicant has developed a light device having a contact switch disposed therein, for allowing the light device to be actuated or controlled to generate the lights with the other portions of the users, such as elbows, or body of the users, and thus for allowing the light device to be easily actuated or controlled by the users.

For example, U.S. Pat. No. 5,930,060 to Shih discloses the typical light device actuatable or operatable by a contact switch, in order to generate lights when the light device is contacted by the users.

However, the light device may not be automatically actuated or operated to generate the lights to light the light device, and is required to be actuated or operated with the contact switch, by contacting the light device.

The present invention has arisen to mitigate and/or obviate the afore-described disadvantages of the conventional light devices.

SUMMARY OF THE INVENTION

The primary objective of the present invention is to provide a light device including an automatic control device to actuate or to operate the light elements or members to generate light automatically when users move toward the light device, without contacting the light device.

In accordance with one aspect of the invention, there is provided a light device comprising a housing including a chamber formed therein, at least one light member disposed in the chamber of the housing, for generating light, and a remote detecting device for detecting whether a user goes toward the light device or not, and to actuate the light member to generate the light when the user has been detected to go toward the light, such that the light member may be actuated or operated automatically without being actuated or depressed or contacted or operated by the users manually.

A control device may further be provided and coupled between the remote detecting device and the light member, to actuate the light member to generate the light. A stabilizer may further be provided and coupled between the control device to supply a stabilized electric power to the light member.

The remote detecting device includes a light emitting device to generate a light and to detect whether the user goes toward the light or not. The light emitting device is preferably an infrared light emitting device.

The remote detecting device includes at least one indicating light member to indicate working of the light emitting device. The remote detecting device may further includes at least one further indicating light member to indicate a power supply to the remote detecting device.

A frame may further be provided and attached to the housing, and a hood may further be provided and attached to the frame and disposed in front of the light member.

A base may further be provided to support the frame. The housing includes a casing provided therein to support the remote detecting device. The casing includes an orifice formed therein, and a lens received in the casing to block the orifice of the casing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
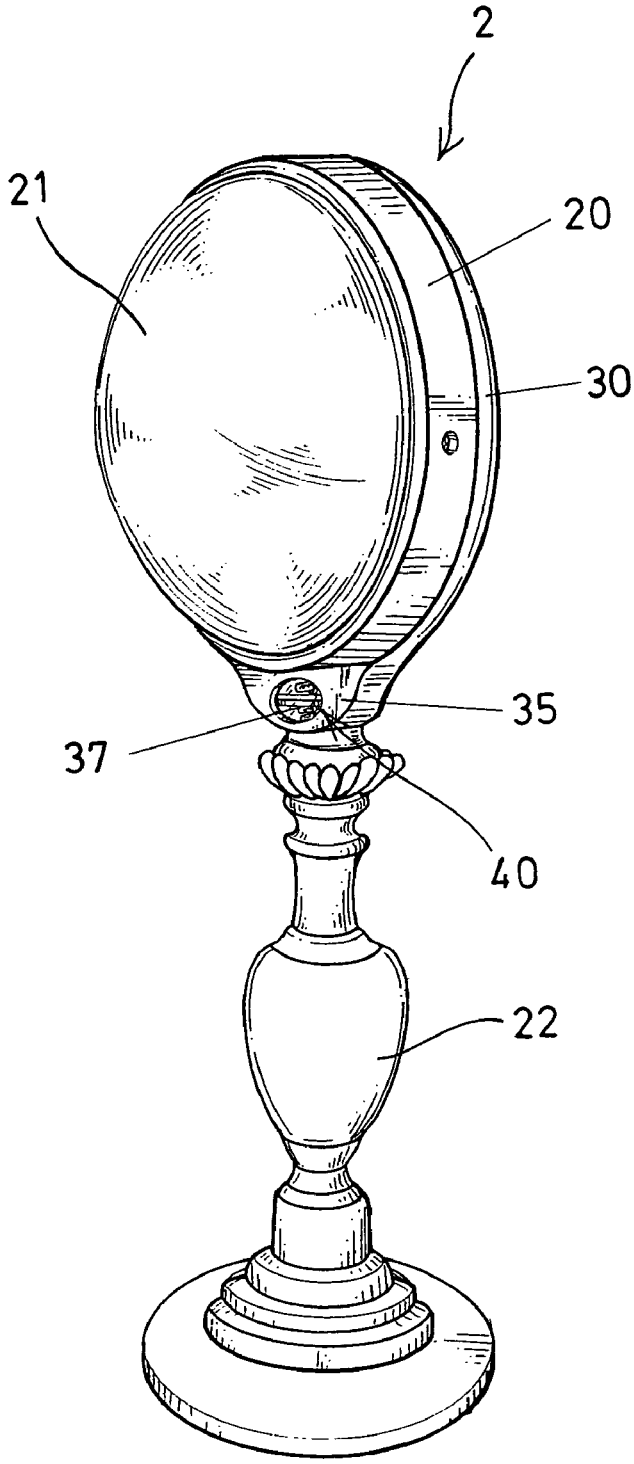
FIG. 1 is a perspective view of a light device in accordance with the present invention.
Figure 2:
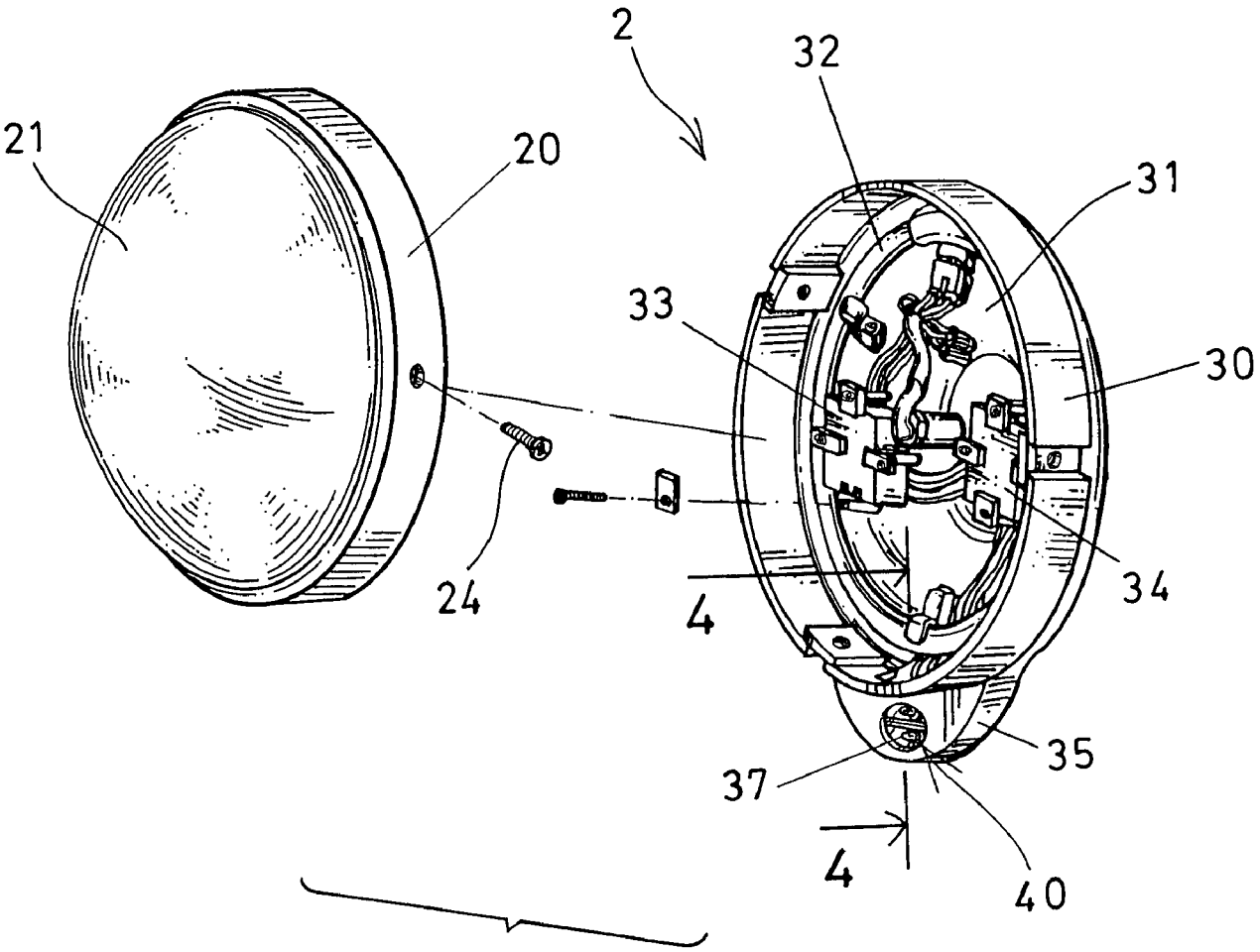
FIG. 2 is a partial exploded view of the light device.
Figure 3:
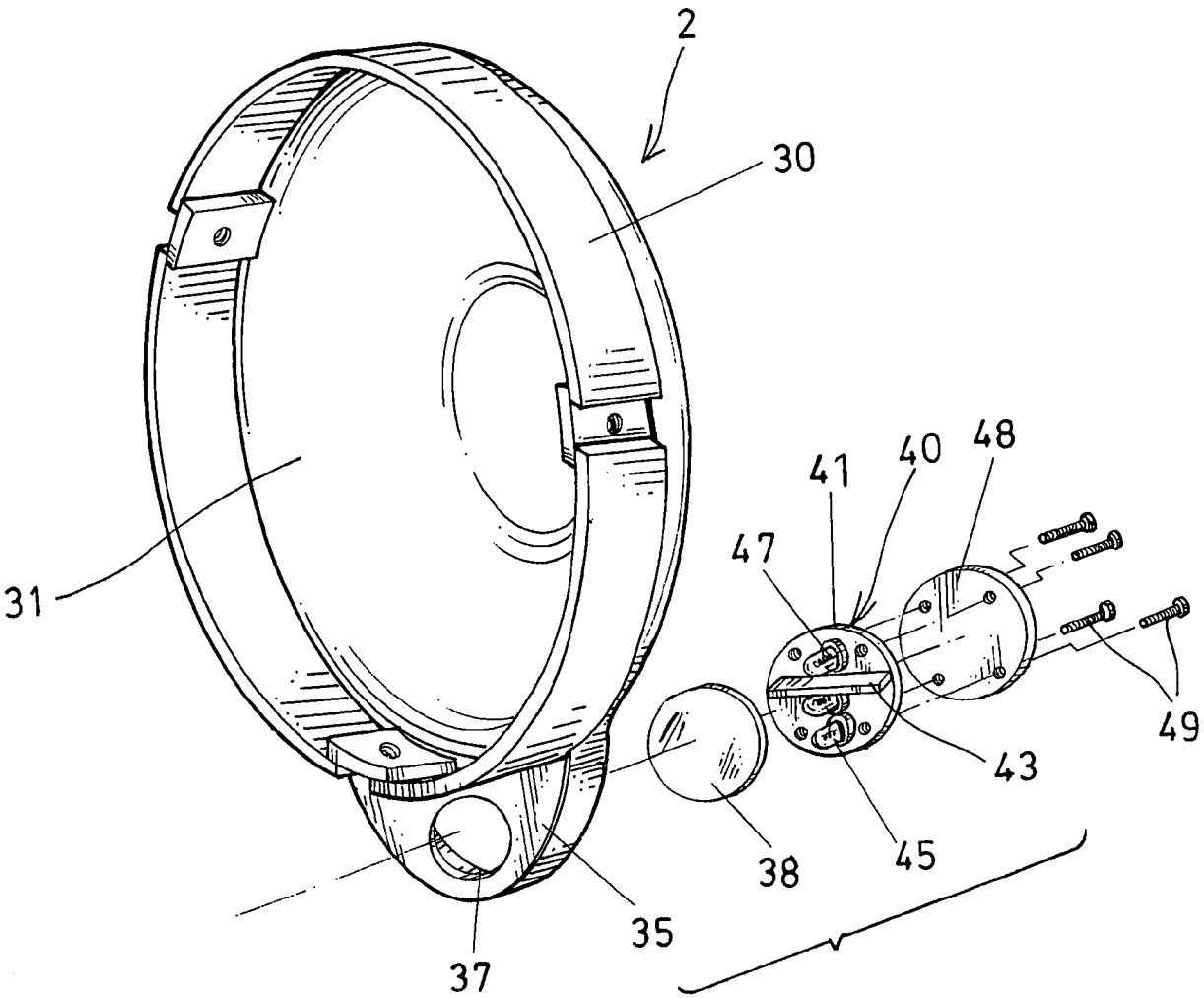
FIG. 3 is another partial exploded view of the light device.
Figure 6:
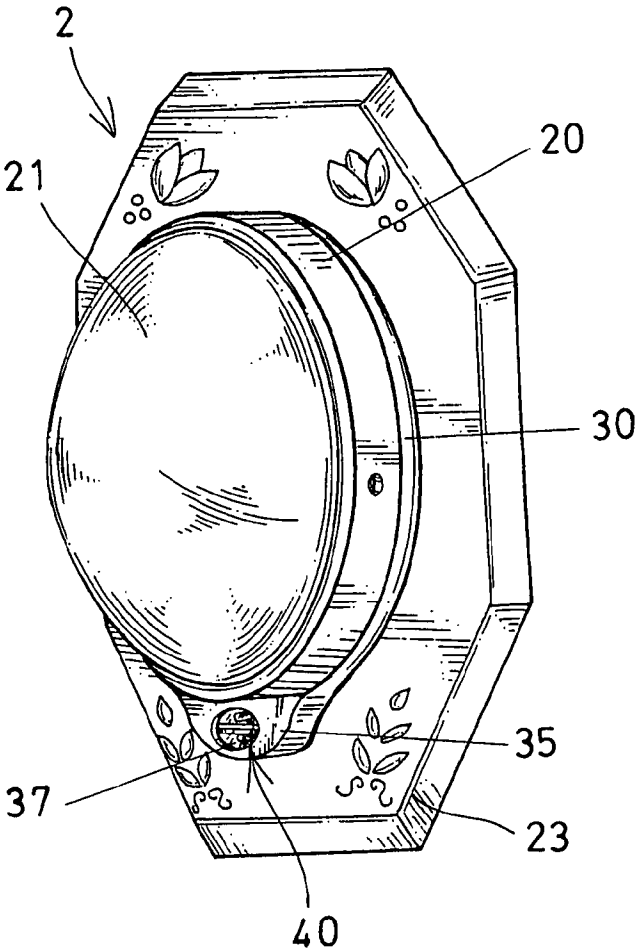
FIG. 6 is a perspective view illustrating the other application of the light device.

Referring to the drawings, and initially to FIGS. 1–3, a light device 2 in accordance with the present invention comprises a frame 20, and a hood 21 or the like attached to the front portion of the frame 20. The frame 20 may be disposed or secured or supported on a base 22 as shown in FIG. 1, for being supported on desks or ground, or may be attached to a decorative housing 23 as shown in FIG. 6, for attaching to walls (not shown) or the like.

Figure 5:
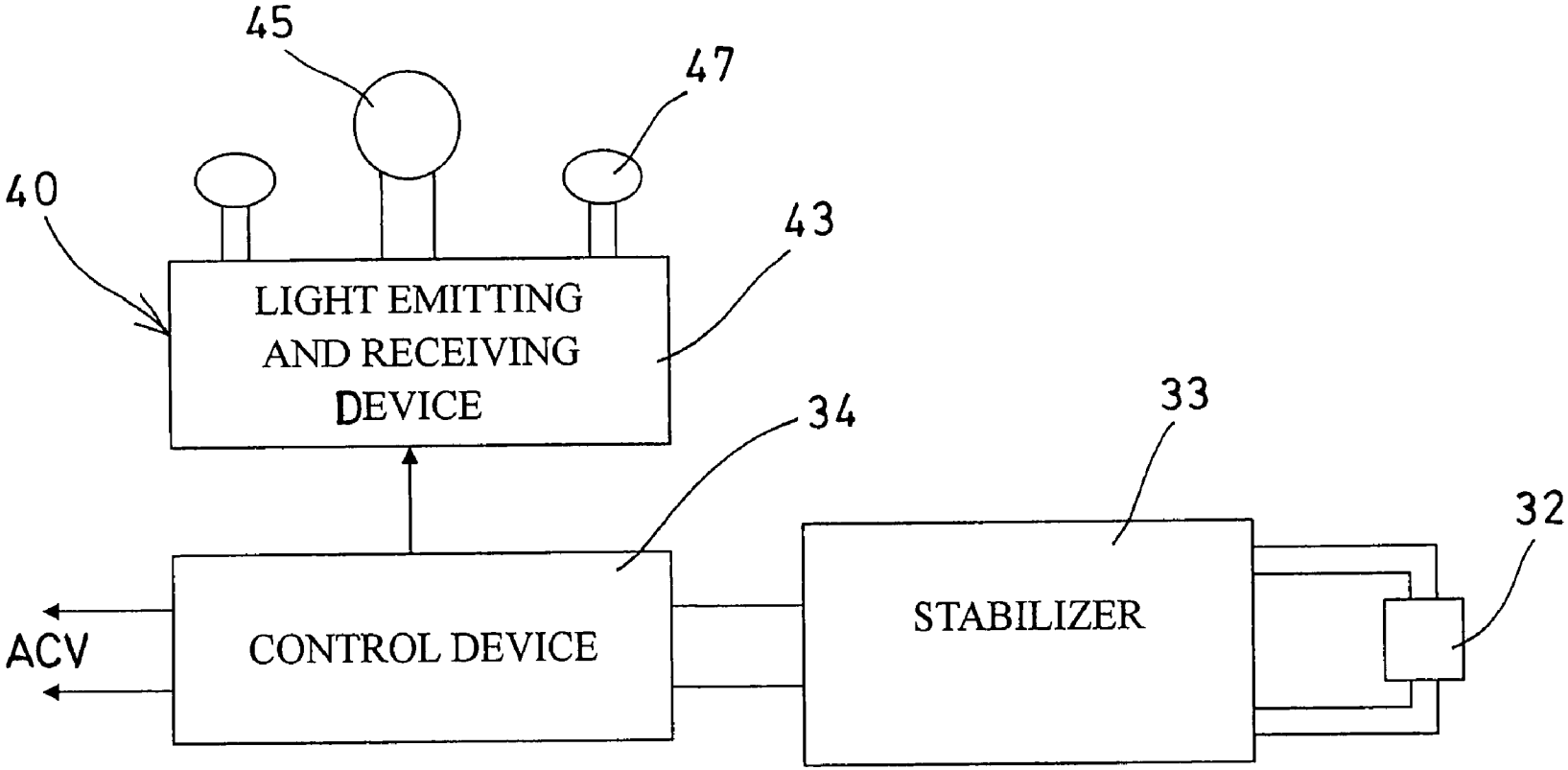
FIG. 5 is a block diagram illustrating the coupling of some of the parts or elements of the light device.

A housing 30 is secured to the rear portion of the frame 20 with such as fasteners 24 (FIG. 2), and disposed behind the hood 21, and includes a chamber 31 formed therein. One or more light elements or members 32 (FIGS. 2, 5), such as light tubes, light bulbs, light emitting diodes, liquid crystal display, or other illuminate devices are disposed in the chamber 31 of the housing 30, for generating light to light the environment, for example.

A stabilizer 33, and a control device 34, such as a processor device 34, are also disposed in the chamber 31 of the housing 30, and coupled to the light members 32 (FIG. 5), to control or to actuate the light members 32 to generate light. The stabilizer 33 may be used to provide or to supply a stabilized electric power to the light members 32.

Figure 4:
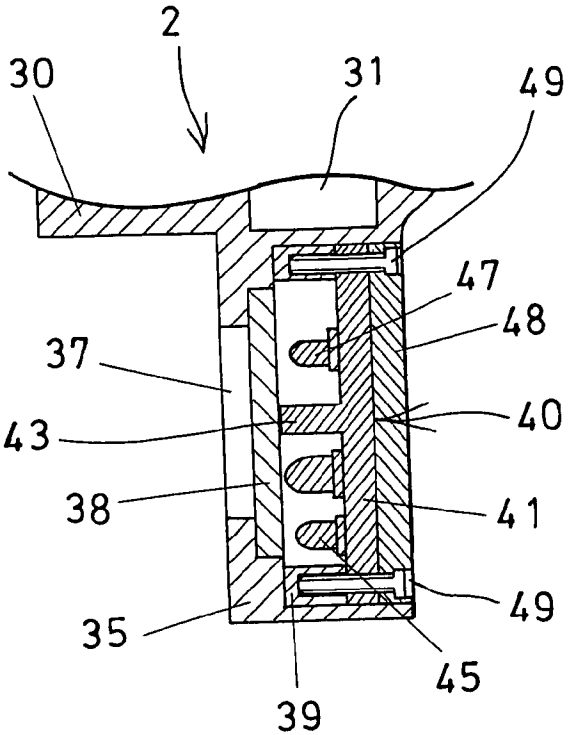
FIG. 4 is a partial cross sectional view of the light device, taken along lines 4—4 of FIG. 2.

The housing 30 further includes an orifice 37 formed therein, such as formed in a casing 35 that is extended from the housing 30, and a glass or transparent or semi-transparent lens 38 disposed in the casing 35 to cover or shield the orifice 37 of the casing 35 or of the housing 30. The housing 30 includes one or more, such as four pins 39 (FIG. 4) extended in the casing 35, for example.

A remote detecting device 40 is further provided and includes a circuit board 41 disposed in the casing 35, and includes a light emitting module or device 43, such as an infrared light emitting device 43 or an infrared light emitting and/or receiving device 43 for generating infrared rays, to detect whether one or more users are going toward or close to the light device 2 or not.

The remote detecting device 40 further includes one or more indicating light members 45 attached to the circuit board 41, to indicate whether an electric power energy has been supplied to the remote detecting device 40 or not, and one or more further indicating light members 47 attached to the circuit board 41, to indicate whether the light emitting and receiving device 43 is working or not.

A cap 48 may be engaged onto the circuit board 41, and/or engaged onto the casing 35, and secured to the casing 35 with such as fasteners 49, to stably retain the lens 38 and the circuit board 41, and the light emitting and receiving device 43, and the indicating light members 45, 47 in the casing 35 or in the housing 30.

In operation, the light emitting and receiving device 43 may generate lights, such as infrared rays out through the lens 38 or the orifice 37 of the casing 35 or of the housing 30, to detect whether one or more users are going toward or close to the light device 2 or not.

When light emitting and receiving device 43 has detected that one or more users are going toward or close to the light device 2, the control device 34 may control or actuate the light members 32 to generate light, such that the light members 32 may be actuated or operated automatically without being actuated or depressed or contacted or operated by the users manually.

Accordingly, the light device in accordance with the present invention includes an automatic control device to switch or to control light members to generate light automatically when users move toward the light device, without being actuated or depressed or contacted or operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A light device comprising:

a housing including a chamber formed therein;

at least one light member disposed in said chamber of said housing, for generating light;

a remote detecting device for detecting movement outside the housing, and having a light emitting and receiving device, being an infrared light emitting device for generating infrared light beam in response to a signal generated by the remote detecting device;

wherein said remote detecting device includes a first indicating light member to indicate status of said light emitting device and a second indicating light member to indicate power supply to said remote detecting device;

a control device coupled between said remote detecting device and said at least one light member to actuate said at least one light member to generate the light, wherein said housing includes an extension extending out of the housing to receive said remote detecting device, wherein said extension includes an orifice formed therein to receive therein a lens on one open end of the orifice and a cap on the other open end of the orifice to sandwich therein the remote detecting device with the lens; and a stabilizer coupled between said control device and the light member to supply a stabilized electric power to said at least one light member.

* * * * *